US005452929A

United States Patent [19]

Anderson

[11] Patent Number: 5,452,929

[45] Date of Patent: Sep. 26, 1995

[54] KEYLESS DOOR LOCK

[75] Inventor: Ronald R. Anderson, Hermitage, Pa.

[73] Assignee: Universal Development Enterprises, Girard, Ohio

[21] Appl. No.: 206,631

[22] Filed: Mar. 7, 1994

[51] Int. Cl.[6] ..... E05L 19/18

[52] U.S. Cl. ..... 292/288; 292/259 R

[58] Field of Search ..... 292/259 R, 259 A, 292/260, 289, 264, 300; 160/327, 351; 49/9

[56] References Cited

U.S. PATENT DOCUMENTS

| | | | |
|---|---|---|---|
| 1,648,383 | 11/1927 | Gage | 49/9 |
| 2,404,124 | 7/1946 | Des Roches | 292/259 |
| 3,980,328 | 9/1976 | Pearson . | |
| 4,067,598 | 1/1978 | Mansour . | |
| 4,082,332 | 4/1978 | Palmer . | |
| 4,095,830 | 6/1978 | Spellman | 292/259 R X |
| 4,335,910 | 6/1982 | Massie . | |
| 4,429,911 | 2/1984 | O'Neal et al. . | |
| 4,462,625 | 7/1984 | Barnhill . | |
| 4,667,992 | 5/1987 | Roden, Jr. . | |
| 4,671,014 | 6/1987 | Lack . | |
| 4,974,889 | 12/1990 | North . | |
| 5,026,102 | 6/1991 | Pitman | 292/259 R |
| 5,165,741 | 11/1992 | Everett . | |
| 5,207,260 | 5/1993 | Commesso | 160/351 X |

*Primary Examiner*—Peter M. Cuomo
*Assistant Examiner*—Jerry Redman
*Attorney, Agent, or Firm*—Frank H. Foster; Kremblas, Foster & Millard

[57] ABSTRACT

A security apparatus for restricting the opening of a door in a frame consisting of lag bolts screwed into the frame near opposite edges of the door and a nylon belt fastened to each lag bolt. An aperture is formed near each end of the belt and the lag bolts are extended through the apertures in order to fasten the belt to the bolts. The belt can be elongated slightly, and it is preferred that the distance between the apertures is slightly less than the distance between the bolts. Any elongation above a specified amount requires substantially higher force than that required to elongate the belt for putting it in its operable position.

22 Claims, 3 Drawing Sheets

KEYLESS DOOR LOCK

TECHNICAL FIELD

This invention relates broadly to the field of security devices for securing a door, and more specifically relates to an apparatus which is fastened on two sides of a door and extends across the door for restricting the opening of the door.

BACKGROUND ART

Security devices are necessary in order to prevent people from entering rooms or buildings which they are not authorized to enter and causing personal injury to occupants and committing theft. Most buildings use a locking door handle, or at most a deadbolt lock for this purpose. These locks suffice for many applications, but can be defeated by a sufficient force exerted against the door, causing the structure into which the deadbolt or locking latch extends to rupture, giving way to entry. Even if an alarm sounds notifying authorities, a person breaking into a building can usually remove some items from the building or harm the occupants and exit the premises before the authorities arrive.

In order to prevent the entry of any unauthorized people, devices have been conceived which attach to the door frame near opposite edges of a door, on the side of the door toward which the door opens, which provide greater resistance to the opening of the door than deadbolts and standard door latches.

In U.S. Pat. No. 4,067,598, Mansour provides a telescoping bar which fastens on one side of the door into the 2×4 framing of the door. The bar is pivotally attached to a bolt which extends into the framing, allowing the bar to pivot from a vertical position, where it can be stored without restricting the use of the door, to its horizontal position across the door. The bar fastens on the opposite side of the door to a locking fastener. A plurality of blocks of specified thickness are placed between the bar and the door to prevent substantial motion of the door.

One disadvantage of the Mansour invention is that a sufficient force exerted on the door will cause the bar to bend, allowing the distal end to slide horizontally out of the locking fastener and permit the opening of the door. Additionally, the mechanisms of the Mansour apparatus make it seem unsightly, which may prevent its use in residential applications. Furthermore, even if entry is prevented by the device, damage may be caused to the door due to the door pressing against the small blocks, or hitting against the narrow bar. Due to the small contact area between the door and the rod and blocks, the force of attempted entry may force the rod or blocks into the surface of the door. Because there is a lock on the fastening side, the further disadvantage exists of requiring that a key be kept available or a combination be remembered.

Another security device is shown in U.S. Pat. No. 4,974,889 to North. The apparatus consists of a cable covered by a sheath, and having one circular loop at each opposite end of the cable. A bolt having a circular opening at one end is fastened to the door framing on one side of the door with the opening exposed and pivotally attached to one loop of the cable. A second bolt having a hook at one end is fastened to the frame of the door on the opposite side from the first fastener and the second loop of the cable is removably fastenable to the hook.

The North apparatus has the disadvantage of being unattractive for some residential applications. For example, the cable is not removable from both fasteners, which means that it must hang, as shown in FIG. 5, near the door when not in use. Additionally, the narrow cable, although covered by a sheath, will probably mar the surface of the door during attempted forced entry. When the door is forced against the cable, the narrow cable will probably cut into the door at the point of contact.

Additionally, because the cable is made of metal fibers, there is little elasticity provided for reducing the shock of a force applied against the cable. A sharp blow to the door immediately applies a lateral force to the two fasteners, potentially jarring them loose enough from the framing members to permit their removal with another sharp blow.

The need exists for a security apparatus for extending across a door and fastening to a frame on opposite sides of the door which will not damage the door upon attempted entry, has some shock reducing characteristics to further prevent entry, and which may be removed from sight.

BRIEF DISCLOSURE OF INVENTION

A security apparatus is disclosed which is used for restricting the displacement of a door in a frame. The apparatus comprises a first anchor which is rigidly fastened to the door frame near a first edge of the door, and a second anchor which is rigidly fastened to the frame near a second edge of the door. A flexible, elastic belt has a pair of fasteners attached to it, each fastener attached near a different opposite end of the belt. The fasteners are used for fastening each end of the belt to a different one of said anchors.

Each fastener may be removably fastenable to an anchor, and the distance between the fasteners is not substantially greater than the distance between the first and second anchors. Preferably the fasteners have a keyhole shape to allow easy attachment to the anchors, but prevent detachment during an attempted forced entry.

Figure 1:
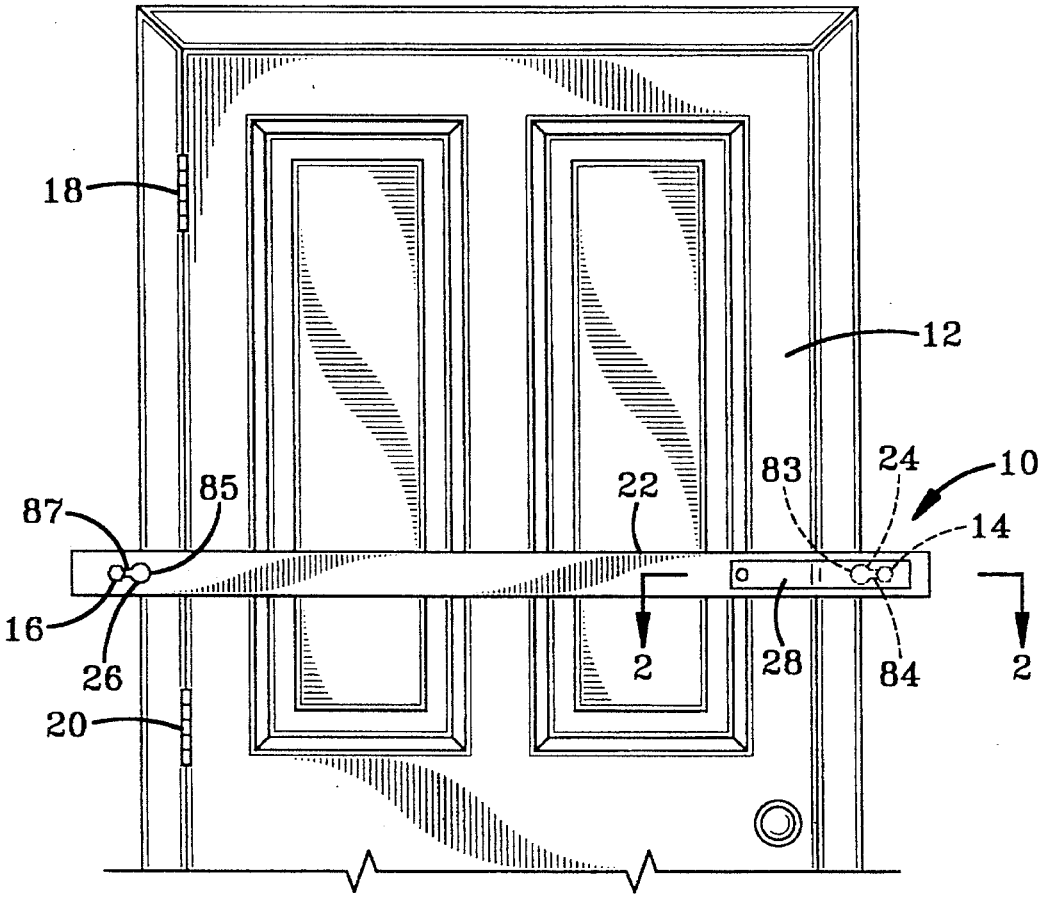
FIG. 1 is a front view illustrating an embodiment of the present invention in its operable position.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Referring to FIG. 1, a security apparatus 10 embodying the invention is shown in its operable position with respect to a door 12. The door 12 is a typical door in a residential structure having a wooden frame (not visible behind the trim in FIG. 1) along its sides and at the top constructed of two inch by four inch dimensional lumber. The door 12 is pivotally mounted to the frame by hinges 18 and 20, allowing the door 12 to pivot about the hinges in a conventional manner.

The security apparatus 10 of the present invention has a first anchor, preferably a bolt 14 (shown by hidden lines), which extends through the conventional trim and into the wooden frame near one edge of the door 12. A second anchor, preferably a bolt 16, also extends through the door trim and into the wall frame near the edge of the door 12 opposite from the bolt 14. The bolts 14 and 16 are preferably conventional steel lag bolts having a threaded shaft approximately ⅜ of an inch in diameter, and a hexagonal head which is approximately ⅝ of an inch in diameter, that is across opposing corners. The bolts 14 and 16 are preferably approximately 4½ inches long and are fastened to the framing by screwing them into the wood in a conventional manner, but leaving the head and a portion of the shaft exposed.

A flexible belt 22, which is preferably elastic, extends horizontally across the door 12. A first aperture 24 (shown by hidden lines) is formed near one end of the belt 22, and a second aperture 26 is formed near the opposite end of the belt 22. The apertures 24 and 26 are formed entirely through the belt 22 and form fasteners for attachment to the bolts 14 and 16. The bolts 14 and 16 extend through the apertures 24 and 26, respectively, when the belt 22 is in its operable position as shown in FIG. 1. A hand-grippable handle 28 is attached near one end of the belt 22, the function of which is described below.

Figure 2:
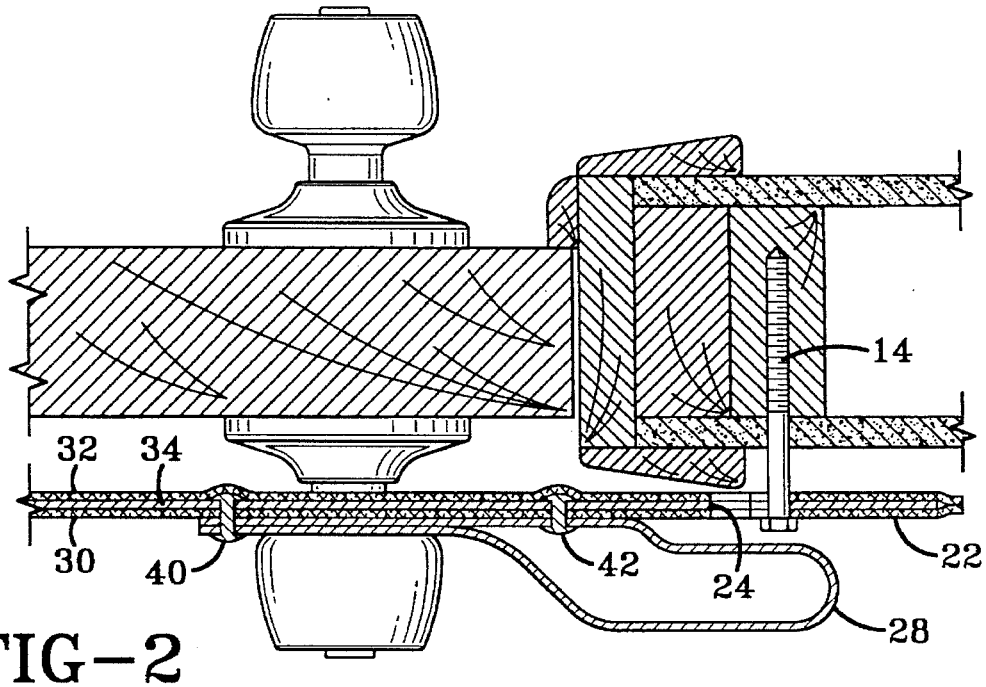
FIG. 2 is a top view in section through the line 2—2 shown in FIG. 1.

The belt 22 is preferably made up of a first belt layer 30 and a second belt layer 32, shown in FIG. 2. These layers 30 and 32 are preferably similar materials of similar dimension. A strap 34 is interposed between the belt layers which are then sewn together at their lateral edges and their ends to make the composite belt 22. Each layer of the belt 22 is preferably approximately 44 inches long, 2 inches wide, and 3/16 of an inch thick.

The strap 34 is a flat strip of hard material which is difficult to cut with readily available tools, such as a knife or scissors. In the preferred embodiment, the strap 34 is a piece of high tensile-strength steel known as tensile steel strap. Alternatively the strap 34 could be hard plastic or wire mesh. The primary functions of the strap 34 are to provide reinforcement at the anchors and to prevent the belt 22 from being severed. Without the strap 34, a person could cut the belt 22 with a knife, but the strap 34 creates a barrier to cutting of the belt 22 with common tools.

The strap 34 extends from near the end of the belt shown in FIG. 2 to near the center of the belt, which is not visible in FIG. 2. The aperture 14 extends through the strap 34. The strap 34 provides structural rigidity to the belt 22 which improves the ease of insertion and maintenance of the bolt 14 in the aperture 24. The strap 34 provides rigidity where it is needed, and in the preferred embodiment leaves a central portion of the length of the belt 22 flexible. The handle 28 is preferably attached to the belt 22 by rivets 40 and 42 extending through the handle 28, the belt layer 30 and the strap 34. In this arrangement, the strap 34 provides structural rigidity to the connection between the handle 28 and the belt 22. Alternatively, or in addition, the handle may be attached by sewing.

Figure 3:
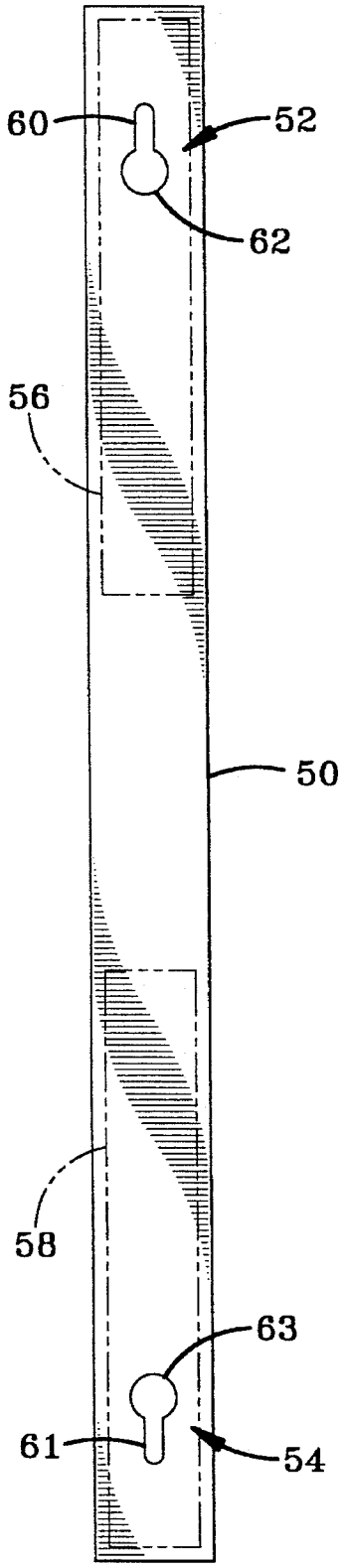
FIG. 3 is a rear view illustrating the preferred belt of the present invention.

A belt 50 is shown in FIG. 3, having a pair of apertures 52 and 54, each aperture at a different opposite end of the belt 50. The belt 50 is similar to that shown in FIGS. 1 and 2, and represents the preferred embodiment of the present invention. In the belt 50 there is a pair of steel straps, each strap positioned between the layers of the belt 50 at a different opposite end of the belt 50. A first steel strap 56, similar to strap 34 shown in FIG. 2, is shown in phantom at one end of the belt 50 and a second steel strap 58 is shown in phantom at the opposite end of the belt 50.

The straps 56 and 58 have dimensions of approximately 8 inches in length, 1½ inches in width, and 1/16 of an inch thick. The two layer arrangement of the belt 50 with the steel strap between the layers results in a total thickness of the belt 50 of ⅜ inch.

The apertures 52 and 54 have a preferred shape which resembles a keyhole. Each aperture 52 and 54 is elongated and aligned longitudinally with the belt 50. The apertures 52 and 54 have slot ends 60 and 61 and bolt head entry ends 62 and 63. The slot ends 60 and 61 of the apertures 52 and 54, respectively, are oriented closer to the nearest end of the belt 50. The slot ends 60 and 61 have a width which is slightly greater than the diameter of the preferred bolt shaft, but substantially smaller than the bolt head, to prevent the bolt head from passing through the slot ends 60 and 61. The slot end width is preferably approximately ⅜ of an inch.

The bolt head entry ends 62 and 63 of the apertures 52 and 54, respectively, are oriented closer to the center of the belt 50 and have a diameter which is greater than the diameter of the preferred bolt heads, to permit the bolt heads to pass through the bolt head entry ends 62 and 63. The diameter of the bolt head entry end is slightly greater than ⅝ of an inch.

Figure 4:
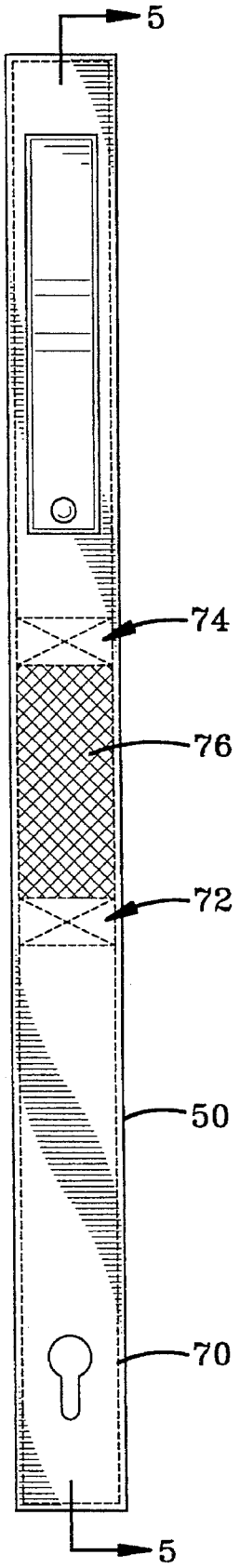
FIG. 4 is a front view illustrating the preferred belt.

In FIG. 4 the belt 50 is shown having sewn stitching 70 all around its lateral edges and ends. The stitching 70 keeps the layers of the belt 50, similar to layers 30 and 32 of belt 22 shown in FIG. 2, attached together. Reinforcing areas 72 and 74 have extra stitching to provide for strength in holding the steel straps 56 and 58 in place between the layers of the belt 50. The belt may be fabricated by wrapping or looping a sufficiently long, single piece of nylon belt around the steel strap and sewing it in place.

An elastic, tension band 76, preferably the same width as belt 50 and approximately 5 inches long, is interposed along the length of one layer of the belt 50. This elastic band 76 provides for increased elasticity of the belt 50 by having substantially greater elasticity than the material making up the belt 50. A longer or shorter elastic band than that of the belt 50 will allow increased or decreased elongation and pull tension of the belt, respectively.

Figure 5:
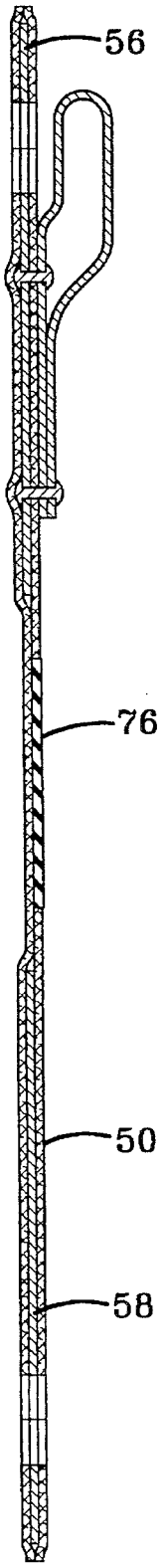
FIG. 5 is a top view in section illustrating the preferred belt.

FIG. 5 shows the straps 56 and 58 in more detail and illustrates the relative placement and thickness of the parts of belt 50. FIG. 5 also shows the layers of the belt 50.

Figure 6:
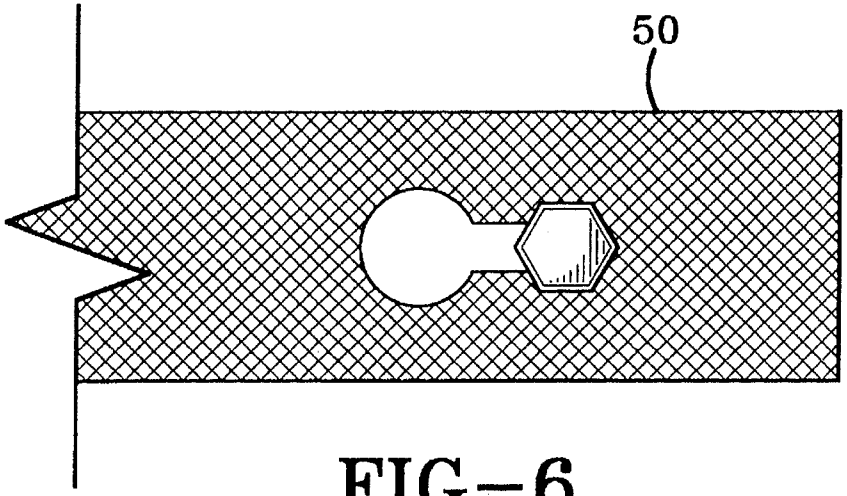
FIG. 6 is a front view illustrating the preferred belt and showing detail of the fiber orientation of the belt.

The preferred belt material is commonly known as nylon towing belt material. The belt is made of nylon fibers which are weaved together with the fibers at angles relative to each other (shown in FIG. 6). The material is somewhat similar to the material used for some automobile seat belts. With such an orientation of the fibers which make up the belt, the application of a longitudinal force to the belt will cause an elongation of the entire belt, and a release of the force will allow the belt to resume its original length, or a length close to it, due to inherent elasticity. When the belt is being elongated and the elongation of the belt is less than a "fiber reorienting limit", the fibers of the belt bend and twist to reorient themselves at smaller angles with respect to each other, which permits further elongation of the belt. Beyond the fiber reorienting limit, a substantially greater force is required to further elongate the belt, because the fibers have already become oriented at as small an angle with respect to each other as possible. Any further elongation of the belt will require longitudinal deformation of the nylon fibers, which requires substantially greater force. There is little or no longitudinal deformation of the fibers below the fiber reorienting limit since the belt elongates primarily by straightening and realignment of the fibers.

The weaved nylon fiber belt will exhibit a given spring constant below the fiber reorienting limit. The spring constant becomes significantly higher above the limit. The fiber reorienting limit represents the point at which the nylon fibers comprising the belt have been reoriented at as small angles relative to each other as possible. Any elongation beyond this point requires some longitudinal deformation of the fibers. This deformation may be elastic or inelastic. In either case, it is understood that the preferred belt exhibits the characteristic of having elasticity, that is, it can be elongated and will assume close to its original length upon release of the elongating force. Below a specified amount of elongation a low force is required to effect that elongation. Above the specified amount of elongation, a substantially higher force is required to cause any further elongation.

FIG. 1 shows the bolts 14 and 16 positioned a selected distance apart on opposite sides of the door 12. That distance has a relation to the distance between the apertures 24 and 26. If, as is not preferred, the distance between the bolts 14 and 16 is substantially less than the distance between the apertures 24 and 26, the belt 22, in its operable position, would hang loosely due to having slack in it. A lot of slack is not desirable since it permits opening of the door beyond an acceptable small distance which may permit entry by a person.

If, as is also not preferred, the distance between the bolts 14 and 16 is substantially greater than the distance between the apertures 24 and 26, then the elasticity of the belt 22 would have to be sufficient to allow the belt 22 to be stretched to fasten it to the bolts 14 and 16 at the apertures 24 and 26. A belt having such high elasticity would permit too much longitudinal elongation to prevent a person from opening the door enough to enter the structure.

However, if the distance between the bolts 14 and 16 is somewhat greater than the distance between the apertures 24 and 26, but not substantially greater, then a small amount of elasticity in the belt 22 will permit its attachment to the bolts 14 and 16, but will also prevent the extended elongation, thereby restricting the opening of the door 12. This is the characteristic of the preferred belt 22 which allows 1" to 1½" of elongation, permitting the door to be ajar by approximately 1". In the preferred embodiment, the anchor bolts are one inch further apart than the apertures.

A belt exhibiting the preferred characteristics will have a relatively lower spring constant at small elongation, changing to a substantially higher spring constant at a greater elongation. In the preferred embodiment, the spring constant becomes substantially higher when the belt is stretched so that the distance between the two apertures 24 and 26 is equal to or not substantially greater than the distance between the bolts 14 and 16.

Aperture 26 of belt 22 has a bolt head entry end 85 and a slot end 87 which are similar to those shown on belt 50 in FIG. 3. Similarly, aperture 24 has a bolt head entry end 83 and a slot end 84.

The installation of the present invention is as follows, with reference to FIGS. 1–5. The belt 22 is positioned with the aperture 26 near the bolt 16. The bolt head entry end 85 of the aperture 26 is aligned with the head of the bolt 16 and the belt 22 is pushed toward the door 12 until the bolt head extends entirely through the belt 22. The person installing the belt 22 next grips the handle 28 and orients the belt 22 in a preferably horizontal position to bring the aperture 24 near the bolt 14. The handle 28 is next pulled horizontally away from the bolt 16, which causes the belt 22 to slide to the right, as shown in FIG. 1, and causes the shaft of the bolt 16 to seat at the leftward most extremity of the aperture 26 in the slot end 87.

The preferred belt 22 is not long enough at this stage of the installation to fasten the right end of the belt 22 to the bolt 14. In order to make the belt 22 long enough, a longitudinal force must be applied to the belt 22 at the handle 28 end to elongate the belt 22 slightly so that the slot end 87 of aperture 26 and the bolt head entry end 83 of aperture 24 are the same distance apart as the bolts 14 and 16. The person installing the belt 22 pulls the handle 28 to the right which elongates the belt 22 slightly due to the fibers orienting themselves at angles less than they had been previously. The force needed to effect this small elongation is a force which can be generated by an average person because the belt 22 has a low spring constant at low elongation. The elongation of the belt 22 aligns the bolt head entry end 83 of the aperture 24 with the head of the bolt 14, and the belt 22 is pushed toward the door 12 until the bolt 14 extends through the bolt head entry end of the aperture 24. The handle 28 is then released and the elastic force of the elongated belt 22 shortens the belt 22, pulling the slot end 84 of the aperture 24 around the shaft of the bolt 14. The bolt 14 then seats against the extreme rightward end of the aperture 24, and the belt 22 is in position as shown in FIG. 1.

In the preferred installed position, the belt 22 cannot be removed from the bolts 14 and 16 by forcing the door 12 against it. Because the bolt head is greater in diameter than the width of the slot ends 84 and 87 of apertures 24 and 26, the belt 22 does not merely slide off the bolts 14 and 16. A force exerted by the door against the belt 22 seats the surface of the belt 22 around the slot ends 84 and 87 against the underside of the bolt head, the greater diameter bolt head keeping the belt 22 from sliding off of the bolts 14 and 16.

The force applied by the door against the belt 22 causes a longitudinal force between the contact point of the door with the belt 22 and each bolt 14 and 16. In the preferred embodiment, the belt mounted on the bolts 14 and 16 has been pre-elongated to near the fiber orienting limit referred to above. Since the belt is pre-elongated, the longitudinal force applied to the belt will need to be substantially higher than that applied to pre-elongate the belt 22 in order to further elongate it because the belt 22 has a substantially higher spring constant above the fiber reorienting limit.

The result of the belt 22 having the characteristics described above is that a low force, that which can be generated by a human being, is all that is necessary to elongate the belt to mount it in its operable position, and a substantially higher force is required to elongate the belt 22 any further. Therefore, the preferred belt, which can withstand a longitudinal force of at least 2,000 pounds before breaking all the while exhibiting little elongation under the 2,000 pound force, will elongate only a negligible amount more than the amount necessary to mount the belt in its preferred position. This prevents an unauthorized person from entering the dwelling by stretching the belt.

Although it is preferred to have a keyhole shaped aperture formed at each opposite end of the belt, it is also possible to permanently attach one end of a belt near one edge of a door, and only have a keyhole aperture at the opposite side of the door, to function as a fastener as described above. By having removable fasteners at both ends of the belt, which is preferred, the entire belt can be removed from the door for storage so as not to be visible, and therefore providing for a more attractive door.

It is an alternative embodiment of the present invention to provide for different colored belts which make the security apparatus more attractive. In addition to the colored belts, the bolts 14 and 16, shown in FIGS. 1 and 2, can have brass or other attractive caps covering them to enhance their appearance.

Although the preferred embodiment has a pair of steel straps with a space between them near the center of the belt, in an alternative embodiment of the present invention, a single steel strap extends along most of the length of the belt.

Because of the dimensions and the material of the preferred belt used in the present invention, there is little or no damage to a door which is forced against the preferred belt in an attempted entry. The soft material does not scratch or cut into a door when the door is forced against it and, because the preferred belt is wide, the force of the door against the belt is not concentrated in a small area. Additionally, the small, elastic elongation caused by a force applied to the belt, reduces the shock upon the door and the belt. A force which is suddenly applied to the belt is more gradually transmitted to the belt and the associated structures over a longer time period. This reduces the possibility that a sharp blow to a door, and therefore the belt, will jar the bolts from their position in the wall frame. The preferred belt will elongate as much as a one-quarter to one-half inch upon the application of a force to it. Additionally, the nylon which makes up the preferred belt will not rust.

Rather than extending the belt from near one edge of a door to near the opposite edge, as in the preferred embodiment, the present invention can be adapted to extend from near one edge of a door to near an adjacent edge of the door. This makes the present invention able to extend across a corner of a door which may enhance the attractiveness of the apparatus by making it less visible, as well as allow the present invention to be used in various applications.

Figure 7:
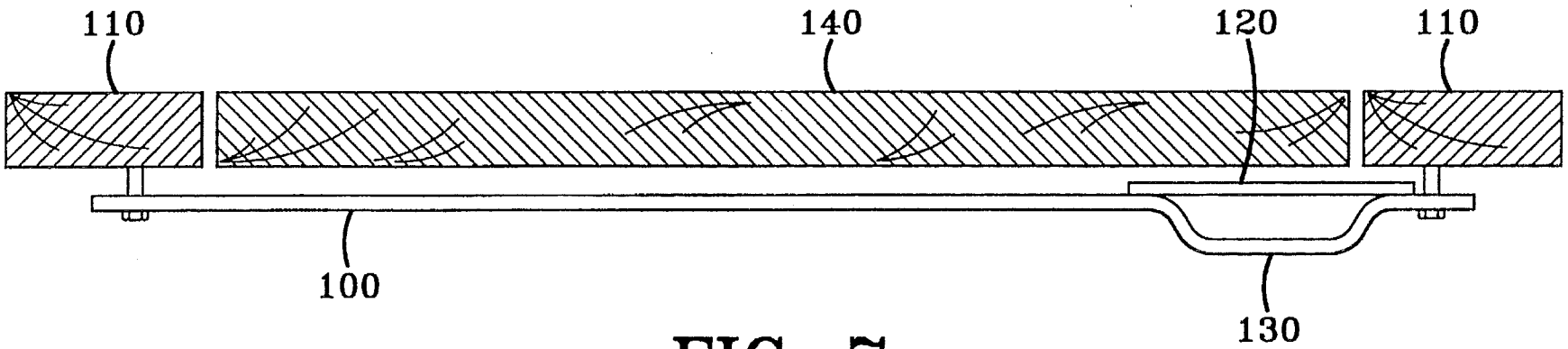
FIG. 7 is a top view in section illustrating an alternative embodiment of the present invention.

FIG. 7 is an alternative embodiment of the present invention showing a belt 100 fastened to a frame 110 in the preferred manner. The belt 100 has an elastic band 120 fastened near one end, which is sewn at two points to the belt 100 to form a loop 130. The elastic band 120 gathers the slack in the loop 130, forming a "take-up" for permitting elongation of the belt 100 for mounting it in its operable position, as shown in FIG. 7. Upon application of a force by the door 140 against the belt 100, the elastic band 120 is elongated and the loop 130 straightens to prevent any further elongation of the belt 100 from occurring, thereby preventing entry through the door 140.

While certain preferred embodiments of the present invention have been disclosed in detail, it is to be understood that various modifications may be adopted without departing from the spirit of the invention or scope of the following claims.

I claim:

1. A security apparatus for restricting displacement of a door in a frame, comprising:

(a) a first anchor, rigidly fastened to the frame near a first edge of the door;

(b) a second anchor, rigidly fastened to the frame near a second edge of the door;

(c) a flexible, elastic belt; and (d) a pair of fasteners, each fastener attached near a different opposite end of the belt, for fastening each end of the belt to a different one of said anchors, the distance between the fasteners being less than the distance between the anchors wherein the belt has a sufficient elasticity to permit the belt to be elongated by a human user until the distance between the fasteners at least equals the distance between the anchors for manual attachment of the belt between the anchors.

2. A security apparatus in accordance with claim 1 wherein each fastener is removably fastenable to an anchor.

3. A security apparatus in accordance with claim 2 wherein each anchor is near a different, opposite edge of the door.

4. A security apparatus for restricting displacement of a door in a frame, comprising:

(a) a first anchor, rigidly fastened to the frame near a first edge of the door;

(b) a second anchor, rigidly fastened to the frame near a second edge of the door;

(c) a flexible, elastic belt; and (d) a pair of fasteners, each fastener attached near a different opposite end of the belt, for fastening each end of the belt to a different one of said anchors wherein the door is hinged to the frame along the second edge, wherein the first anchor has a shaft with a head larger than the shaft protruding from the frame, and wherein the fastener at the end of the belt for attachment to the first anchor includes an aperture having a slot end positioned closer to the nearest end of the belt and having a width greater than the diameter of the bolt shaft and less than the diameter of the head and a bolt head entry end closer to the center of the belt having a diameter greater than the diameter of the bolt head.

5. A security apparatus in accordance with claim 4 wherein the distance between the belt fasteners is not greater than substantially the distance between the anchors.

6. A security apparatus in accordance with claim 5 wherein the distance between the belt fasteners is less than the distance between the anchors.

7. A security apparatus for restricting displacement of a door in a frame, comprising (a) a first anchor, rigidly fastened to the frame near a first edge of the door;

(b) a second anchor, rigidly fastened to the frame near a second edge of the door;

(c) a flexible, elastic belt; and p1 (d) a pair of fasteners, each fastener attached near a different opposite end of the belt, for fastening each end of the belt to a different one of said anchors wherein the distance between the fasteners is less than the distance between the first and second anchor, and a force necessary to elongate the belt, thereby increasing the distance between the fasteners to equal the distance between the first and second anchor, can be generated by a human.

8. A security apparatus in accordance with claim 7 wherein the belt is made of fibers.

9. A security apparatus in accordance with claim 8 wherein the fibers of the belt are oriented at angles to each other, and a longitudinal force applied to the belt causes elongation of the belt at low but increasing force as the fibers are re-oriented at smaller angles to each other, and above a specific amount of elongation substantially greater force is required to elongate the belt further, since the fibers become oriented at as small angles as possible and any further elongation requires the longitudinal deformation of the fibers.

10. A security apparatus in accordance with claim 9 wherein the belt exhibits a given spring constant at low longitudinal force and elongation, becoming a significantly higher spring constant above a given elongation, that given elongation representing point at which the fibers have been re-oriented at as small angles as possible, and any further elongation requires longitudinal deformation of the fibers.

11. A security apparatus in accordance with claim 9 wherein the fibers are nylon.

12. A security apparatus in accordance with claim 11 wherein the belt further comprises two layers of weaved fibers attached together at lateral edges of the belt.

13. A security apparatus in accordance with claim 12 wherein at least one strap is positioned between the two layers of the belt for preventing cutting of the belt.

14. A security apparatus in accordance with claim 13 wherein the strap is steel.

15. A security apparatus in accordance with claim 14 wherein a pair of steel straps is positioned between the two layers of the belt, a first strap near one end of the belt and a second strap near the opposite end of the belt.

16. A security apparatus in accordance with claim 15 wherein an elastic band is interposed along the length of at least one layer of the belt.

17. A security apparatus in accordance with claim 15 wherein both anchors are bolts, each bolt comprising a threaded shaft and a head that is larger in diameter than the shaft.

18. A security apparatus in accordance with claim 17 wherein a fastener aperture is formed near each opposite end of the belt, extending entirely through the layers of the belt and the steel strap at each end of the belt, through which the head of each bolt can extend.

19. A security apparatus in accordance with claim 18 wherein each aperture is elongated and aligned longitudinally with the belt, and each aperture comprises a slot end which is oriented closer to the nearest end of the belt and has a width slightly greater than the diameter of the bolt shaft, and a bolt head entry end which is oriented closer to the center of the belt and which has a diameter greater than the diameter of the bolt head.

20. A security apparatus in accordance with claim 19 wherein a hand-grippable handle is attached near one end of the belt.

21. A security apparatus for restricting displacement of a door in a frame, comprising:

(a) a first anchor, rigidly fastened to the frame near a first edge of the door;

(b) a second anchor, rigidly fastened to the frame near a second edge of the door;

(c) a flexible belt having sufficient longitudinal elasticity to permit the belt to be elongated by a human user; and (d) a pair of fasteners, each fastener attached near a different opposite end of the belt, for removably fastening each end of the belt to a different one of said anchors.

22. A security apparatus in accordance with claim 21 wherein the belt is elastic.

* * * * *

UNITED STATES PATENT AND TRADEMARK OFFICE

CERTIFICATE OF CORRECTION

PATENT NO. : 5,452,929

DATED : Sep. 26, 1995

INVENTOR(S) : Ronald R. Anderson

It is certified that error appears in the above-indentified patent and that said Letters Patent is hereby corrected as shown below:

Column 5, line 23, delete "any further" and insert --any further--.
Column 5, line 28, delete "not" and insert --not--.
Column 5, line 45, delete "substantially" and insert --substantially--.
Claim 7, column 8, line 51, delete "p1(d)" and insert --1(d)--.
Claim 10, column 9, line 13, after "representing" insert --a--.

Signed and Sealed this

Thirteenth Day of February, 1996

Bruce Lehman

*Attest:*

BRUCE LEHMAN

*Attesting Officer*

*Commissioner of Patents and Trademarks*